US005570642A

United States Patent [19]

Lehrman

[11] Patent Number: 5,570,642

[45] Date of Patent: Nov. 5, 1996

[54] ADJUSTABLE IRONING BOARD ASSEMBLY

[76] Inventor: David Lehrman, 207 Barclay Cir., Cheltenham, Pa. 19012

[21] Appl. No.: 369,599

[22] Filed: Jan. 6, 1995

[51] Int. Cl.[6] ..... A47B 5/04

[52] U.S. Cl. ..... 108/47; 108/33; 108/134; 248/214; 248/240.4; 211/87; 211/104; 292/341.15

[58] Field of Search ..... 108/47, 33, 42, 108/48, 46, 134, 135, 26, 25, 38, 34, 40, 152; 312/313, 314, 316; 248/214, 215, 240.4; 211/87, 103, 104, 106; 292/341.15

[56] References Cited

U.S. PATENT DOCUMENTS

| | | | |
|---|---|---|---|
| Re. 33,918 | 5/1992 | Simpson | 29/437 |
| D. 291,613 | 8/1987 | Forbes | D32/66 |
| 523,355 | 7/1894 | Kinley et al. | 108/135 |
| 667,164 | 1/1901 | Carder | 108/48 |

(List continued on next page.)

FOREIGN PATENT DOCUMENTS

| | | | |
|---|---|---|---|
| 252655 | 3/1991 | Australia | 211/88 |
| 648216 | 9/1962 | Canada . | |
| 515889 | 4/1921 | France . | |
| 821642 | 12/1937 | France . | |
| 2388922 | 11/1978 | France . | |
| 2466217 | 4/1981 | France . | |
| 199814 | 3/1958 | Germany . | |
| 293132 | 7/1928 | United Kingdom . | |
| 370129 | 4/1932 | United Kingdom . | |
| 652438 | 4/1951 | United Kingdom . | |
| 853043 | 11/1960 | United Kingdom . | |
| 2114007 | 8/1983 | United Kingdom . | |

OTHER PUBLICATIONS

Closet Concepts, Inc. Product Literature, "Built–In Ironing Centers by Iron–A–Way®," dated Oct., 1985.
Nutone Ironing Center Brochure (Late 1987).
Handi–Press Brochure (Mid 1988).
Sico Ironing Center (Mid 1988).
Compact Ironing Board (Late 1988).
Hold Everything Catalog (Early 1989).
Hold Everything Catalog (Early 1987).
Sturbridge Yankee Workshop (Early 1987).
Iron–A–Way Brochure (Early 1987).
Hide–Away Brochure (Early 1989).
Hechinger Flyer (Jun. 1987).
Solutions Catalog (1989).
Traditions Catalog (Early 1987).
CGK Catalog (Early 1987).

*Primary Examiner*—James R. Brittain
*Assistant Examiner*—Janet M. Wilkens
*Attorney, Agent, or Firm*—Seidel, Gonda, Lavorgna & Monaco, P.C.

[57] ABSTRACT

An ironing board for mounting to a structure, such as a wall or door, and which is pivotally attached to a frame. The ironing board pivots between a vertical position when stored and a horizontal position when in use. The mounting frame is configured as an inverted, U-shaped structure with vertically oriented legs positioned on opposite sides of the ironing board. The ironing board can be vertically displaced while in its horizontal position, so as to permit the easy placement and removal of an ironing board cover. The frame is mounted to a door or wall through a bracket which has protruding members formed thereon designed to engage with corresponding slotted keyways in the mounting frame. Vertical adjustment of the frame is achieved by engaging appropriate slotted keyways with the protruding members. In one embodiment of the invention, the bracket has a hook portion formed thereon which extends over the top of a door for supporting the mounting frame therefrom. In an alternate embodiment of the invention the bracket is mounted to the inside of a cabinet, which has a cover hingedly mounted thereto for enclosing the mounting frame and ironing board. Guides are formed on the mounting frame to vertically orient the bracket and to prevent the lateral displacement of the mounting frame with respect to the bracket. Mounting members, such as tabs, are formed on the mounting frame for supporting a basket.

29 Claims, 8 Drawing Sheets

U.S. PATENT DOCUMENTS

| | | | |
|---|---|---|---|
| 743,517 | 11/1903 | Joyal | 108/33 |
| 920,343 | 5/1909 | Kelly et al. | 108/135 |
| 1,136,878 | 4/1915 | Hornschuch . | |
| 1,506,240 | 8/1924 | Ives | 108/134 |
| 1,558,409 | 10/1925 | Stienecker . | |
| 1,576,034 | 3/1926 | Butt | 108/134 |
| 1,595,628 | 8/1926 | Small | 108/48 |
| 1,696,145 | 12/1928 | Wagoner | 108/48 |
| 1,699,766 | 1/1929 | Starr et al. | 108/48 |
| 1,766,154 | 6/1930 | Triller | 127/38 |
| 1,843,391 | 2/1932 | Gayle | 108/47 |
| 1,868,185 | 7/1932 | Worley, Jr. et al. . | |
| 1,887,763 | 11/1932 | Juvet | 108/38 |
| 2,236,717 | 4/1941 | Noack | 108/33 |
| 2,386,139 | 10/1945 | Rasmussen | 108/135 |
| 2,498,428 | 2/1950 | Kruse . | |
| 2,535,755 | 12/1950 | Rieter | 108/39 |
| 2,567,538 | 9/1951 | Anderson | 38/127 |
| 2,633,998 | 4/1953 | Derman | 108/135 |
| 2,743,023 | 4/1956 | Larson | 211/96 |
| 2,829,855 | 4/1958 | Gibson | 248/201 |
| 2,925,916 | 2/1960 | Pollock | 211/86 |
| 2,959,297 | 11/1960 | Larson | 211/90 |
| 3,129,676 | 4/1964 | Brooks et al. | 108/33 |
| 3,170,417 | 2/1965 | Avidiya | 108/50 |
| 3,245,161 | 4/1966 | Adiletta et al. | 38/104 |
| 3,346,886 | 10/1967 | Kashiwamura | 108/134 X |
| 3,536,287 | 10/1970 | Kramer | 248/215 |
| 3,663,080 | 5/1972 | Ayers | 312/237 |
| 3,680,235 | 8/1972 | Leemhuis | 38/104 |
| 3,965,588 | 6/1976 | Long | 381/103 |
| 4,318,486 | 3/1982 | Bobrowski | 211/87 |
| 4,382,641 | 5/1983 | Abel | 312/21 |
| 4,480,556 | 11/1984 | Wilson et al. | 108/48 |
| 4,657,249 | 4/1987 | Offutt | 273/1.5 R |
| 4,759,296 | 7/1988 | Simpson | 108/120 |
| 4,769,894 | 9/1988 | Simpson | 29/437 |
| 4,779,539 | 10/1988 | Stislich | 108/48 |
| 4,821,650 | 4/1989 | Simpson | 108/120 |
| 4,862,611 | 9/1989 | Wright | 38/103 |
| 4,899,667 | 2/1990 | Miller et al. | 108/47 |
| 4,961,388 | 10/1990 | Simpson | 108/42 |
| 4,976,205 | 12/1990 | Miller et al. | 108/47 |
| 4,982,516 | 1/1991 | Cervantes | 382/140 |
| 4,995,681 | 2/1991 | Parnell | 108/48 X |
| 5,040,468 | 8/1991 | Miller et al. | 108/47 |
| 5,170,719 | 12/1992 | Pestone | 108/48 |
| 5,272,825 | 12/1993 | Simpson | 38/137 |
| 5,329,860 | 7/1994 | Mattesky | 108/48 |

ADJUSTABLE IRONING BOARD ASSEMBLY

FIELD OF THE INVENTION

The present invention is related to ironing boards and, more particularly, to an adjustable ironing board frame assembly which is designed for mounting on a door or wall and which includes an ironing board that is pivotable for storage.

BACKGROUND OF THE INVENTION

The field of ironing boards has seen significant developments in recent years, most of which have attempted to increase the usefulness and ease of operation of the board itself. One of the most recent improvements has been the mounting of an ironing board directly to the back of a door. By doing so, the problem of storage of the board is eliminated, as is the awkwardness associated with transporting the board from storage to an area where it can be used.

U.S. Pat. No. 4,899,667 illustrates one type of door mounted apparatus. A tubular, U-shaped frame is mounted on the door by two brackets. The ironing board itself is attached to the frame at its heel so as to be pivotable between a horizontal position during use and a vertical position when stored. In order to lock the ironing board in the vertical position, a detent or bumper type mechanism is provided on the frame. To unlock the ironing board from the frame, a portion of the ironing board must be deflected laterally around the detent. A cover may also be attached to the frame to enclose the frame and board when not in use.

Another type of door mounted ironing board assembly is shown in U.S. Pat. No. 4,862,611. In that embodiment, an ironing board is pivotally attached to the bottom of a frame comprising sheet metal angles. A single hook is attached at the top of the frame and engages with the edge of the door.

While the prior art ironing board assemblies have provided some solutions for simplifying the process of ironing, additional problems still exist. For example, the frames in the prior art ironing board assemblies position the ironing board at a set distance above the ground regardless of the potential user's actual height. Accordingly, a person who is 5 feet tall must use a mounted ironing board at the same height as a person who is 6 feet tall. However, a height which is comfortable for one person, may not be as comfortable for another.

Furthermore, in order to provide a lightweight design, many of the prior art assemblies sacrifice sturdiness. Accordingly, the ironing boards do not provide a stable ironing surface without the use of additional supports. For example, the ironing board assembly in U.S. Pat. No. 4,899,667 is manufactured from a lightweight tubular structure which requires suction cups or similar type items to prevent the assembly from laterally shifting.

Additionally, U.S. Pat. Nos. 4,899,667 and 4,862,611 show support braces which attach to the ironing board at a location in close proximity to the mounting frame. As a consequence, the support braces must be exceptionally rigid and heavy to properly react the applied ironing forces on the board.

Another problem with the prior ironing board assemblies is that the mounting of the ironing board to the frame is such that an ironing board cover cannot be easily placed on and removed from the board. Both the '611 and the '667 patents show the heels of the ironing boards hinged directly to the frame. Consequently, standard ironing board covers cannot be used without first being cut at the hinge locations.

A need, therefore, exists for an improved ironing board assembly for mounting to a door or wall, which provides for vertical adjustment of the ironing height, permits the utilization of standard ironing board covers, and has a sturdy construction for accommodating the loads produced during the ironing process.

SUMMARY OF THE INVENTION

One object of the present invention is to provide an ironing board which hangs on a wall or a door that can be vertically adjusted.

Another object of the present invention is to provide an ironing board for hanging on a door or a wall which has a basket mounted thereon for holding items.

These and other objects are achieved through the ironing board of the present invention which includes an ironing board that is pivotally mounted to a frame. The ironing board has a raised, substantially vertical position when stored and a lowered, substantially horizontal position when in use. The mounting frame is configured as an inverted, U-shaped structure with vertically oriented legs positioned on opposite sides of the ironing board. The frame is, preferably, formed from rigid metal angles which are configured so as to minimize the lateral shifting of the frame during ironing.

The frame is mounted to a door or wall through a bracket which, preferably, comprises two vertical straps. The bracket is supported by the wall and has protruding members formed thereon which are designed to engage with corresponding slotted keyways in the mounting frame. Vertical adjustment of the frame is achieved by choosing suitable slotted keyways to engage with the protruding members. In one embodiment of the invention, the bracket has a hook portion formed thereon which extends over the top of a door for supporting the mounting frame therefrom. In an alternate embodiment of the invention the bracket is mounted to the inside of a cabinet, which has a cover hingedly mounted thereon for enclosing the mounting frame and ironing board.

Guides are formed on the frame and operate to vertically orient the bracket. The guides also function, in combination with the protruding members and slotted keyways, to prevent the lateral displacement of the mounting frame with respect to the bracket means.

At least one basket is removably attached to mounting members, such as tabs, formed to the frame. There are, preferably, several tabs spaced vertically apart which permit the height position of basket to be adjusted as desired.

The attachment of the ironing board to the mounting frame is designed to allow vertical displacement of the ironing board, while in its horizontal position, so as to permit the easy placement and removal of an ironing board cover.

The foregoing and other objects features and advantages of the present invention will become more apparent in light of the following detailed description of the preferred embodiments thereof, as illustrated in the accompanying drawings.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

Figure 1:
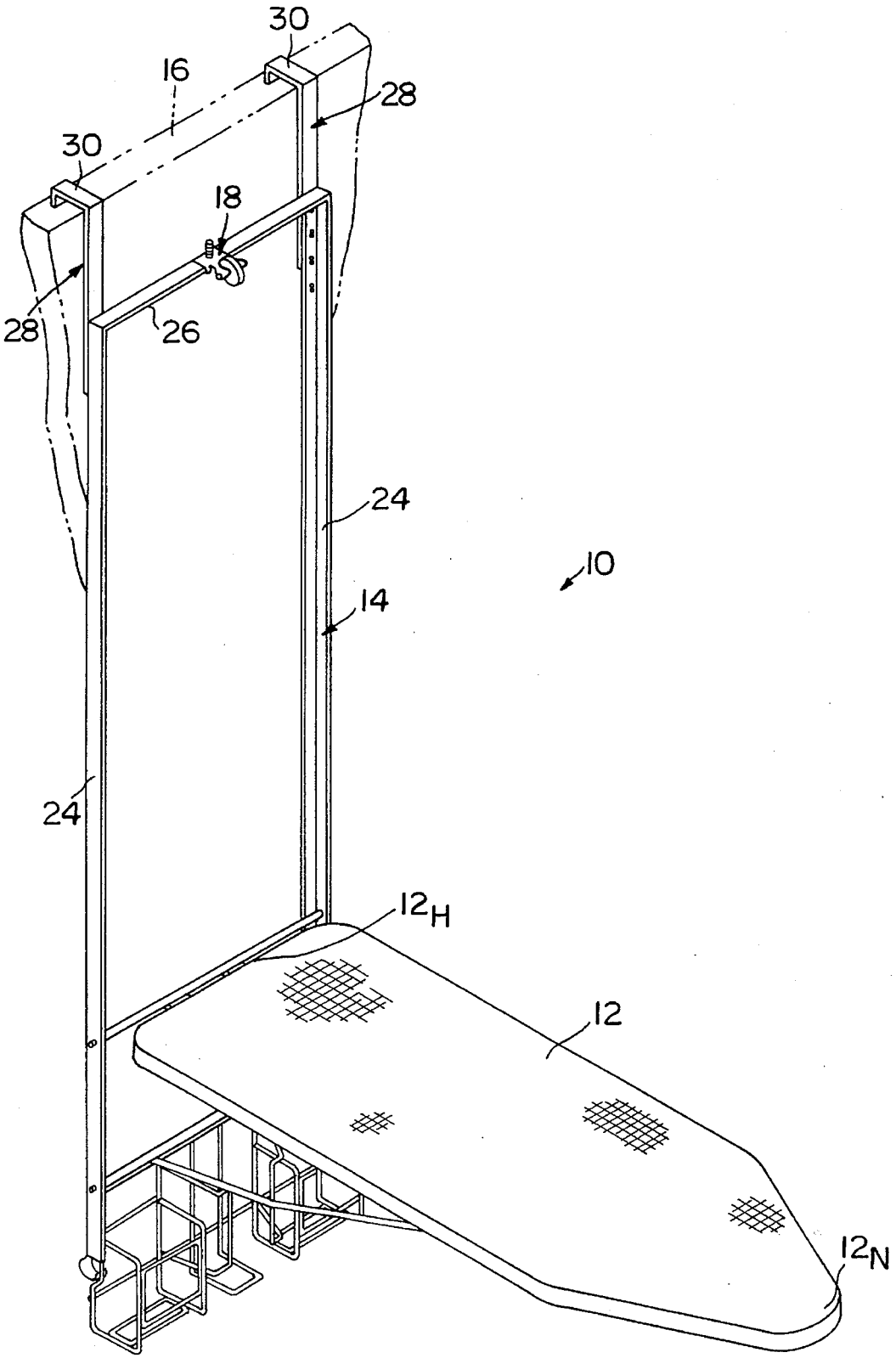
FIG. 1 an isometric view of the door hanging ironing board embodiment of the present invention with the ironing board in its lowered, operative position.
Figure 2:
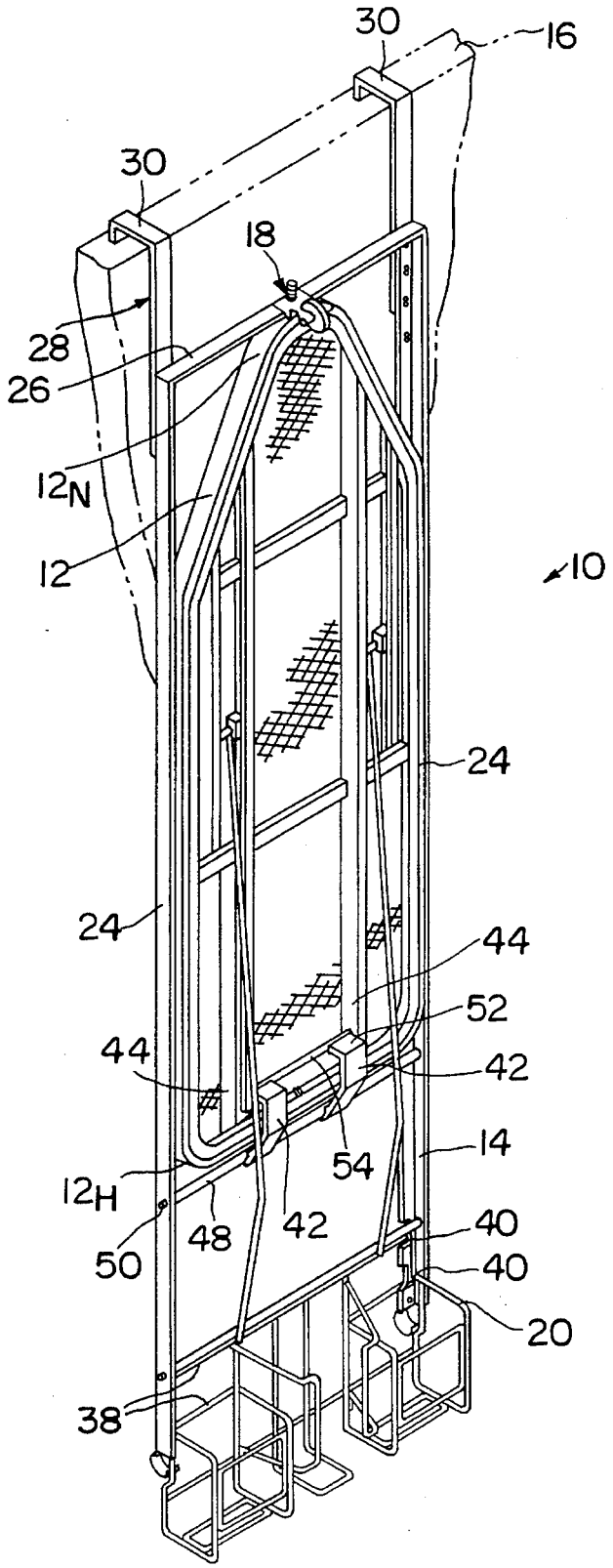
FIG. 2 is an isometric view of the door hanging ironing board embodiment of the present invention with the ironing board in its raised, stored position.

Referring now to the drawings wherein like reference numerals illustrate corresponding or similar elements throughout the several views, FIG. 1 depicts a door mounted ironing board 10 according to the present invention with an ironing board 12, preferably having a normal or standard length, pivotally attached to a mounting frame 14. The mounting frame, in turn, is hung from the top edge of a door 16. The ironing board 12 is capable of being pivoted between a lowered, substantially horizontal position when in use and a raised, substantially vertical position when stored, as shown in FIG. 2. A latch 18 is attached to the mounting frame and retains the ironing board 12 in its vertical, stored position when not in use. An adjustable basket 20 is shown attached to the mounting frame 14 near its bottom.

Figure 3:
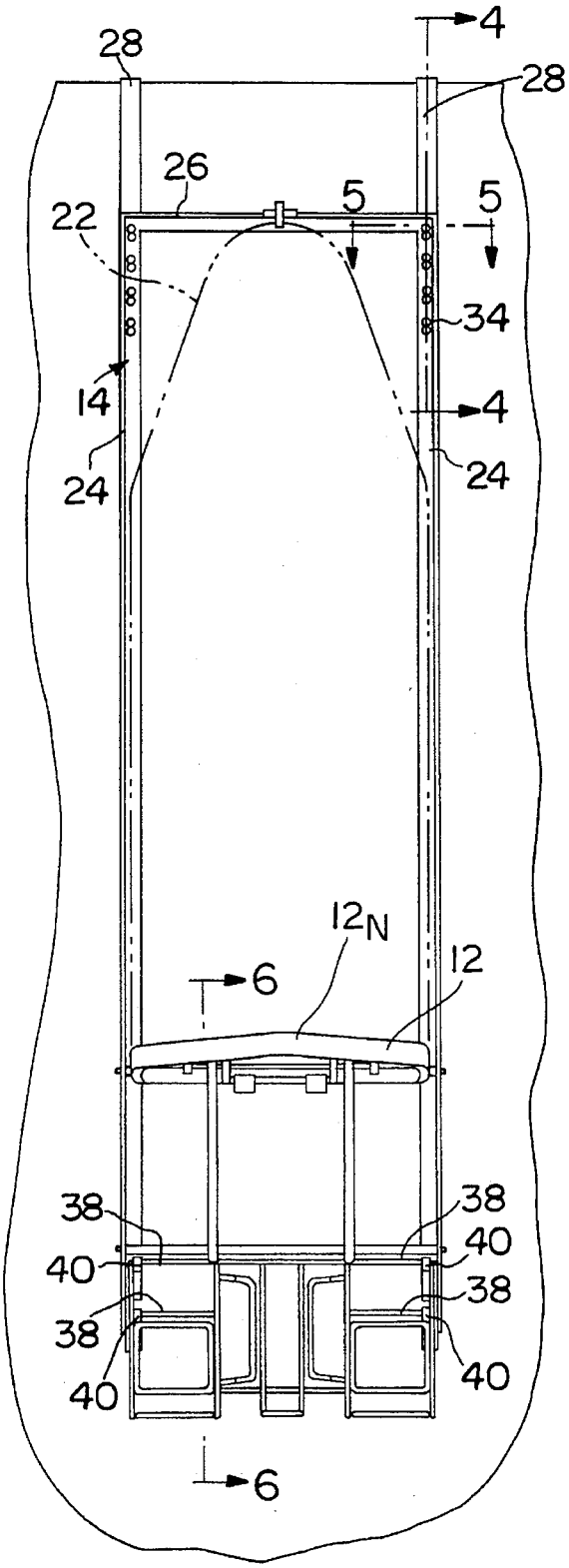
FIG. 3 shows a front view of the door hanging ironing board embodiment of the present invention.

Referring now to FIG. 3, a front view of the door hanging ironing board embodiment 10 is shown with the ironing board 12 in the lowered position. The raised position of the ironing board is indicated in the figure by the phantom lines 22. The mounting frame 14 includes two vertically oriented legs 24 which are preferably parallel to one another and positioned on either side of the ironing board 12. Referring back to FIG. 2, the legs 24 extend from at or above the nose $\mathbf{12}_N$ of the ironing board to a position below the heel $\mathbf{12}_H$ of the ironing board when the ironing board 12 is in the raised position. Near the top of the frame, a crossbar 26 extends between and connects to the two legs 24 at a location that is, preferably, above and in close proximity to the nose $\mathbf{12}_N$ of the ironing board 12. The combination of the two vertical legs 24 and the crossbar 26 form a relatively stable frame to which the ironing board 12 is pivotally mounted. Additional crossbars may be added between the vertical legs 24 of the mounting frame 14 to provide further stability if needed.

Figure 4:
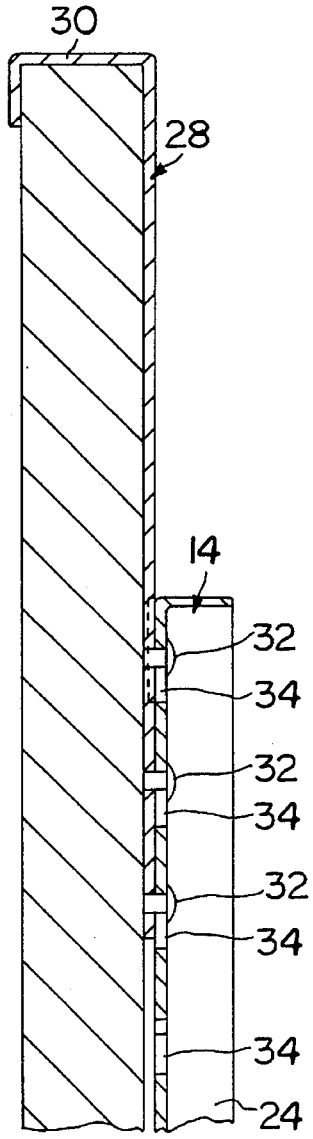
FIG. 4 is a partial side view taken along lines 4—4 in FIG. 3 and illustrates the attachment of the frame to the door according to the present invention.

As is shown in FIGS. 3 and 4, the mounting frame 14 is manufactured from metal angles and straps which provide a relatively strong support structure for the ironing board. Steel is, preferably, utilized for the mounting frame 14 components although other materials, such as aluminum or fiber-reinforced resin matrix composites, may be substituted therefor without detracting from the invention. A tubular frame structure may also be utilized in place of the angles and straps to provide a lightweight, yet strong frame onto which to the ironing board 12 is mounted. A drawback to the use of a tubular frame is that the lightweight construction may result in lateral swaying of the frame and board when the door is opened and closed. Accordingly, additional restraints, such as suction cups, may be required to maintain the frame against the face of the door if a tubular frame is utilized.

The mounting frame 14 is attached to the door 16 by a bracket 28 which provides a means for supporting the mounting frame and includes an inverted, generally J-shaped hook portion 30 that extends across and engages with the top of the door 16. The hook portion 30 of the bracket 28 is, preferably, in the shape of a flat strap which extend upwards from the mounting frame 14 and over the top of the door 16. The thickness of the strap 30 is chosen so as not to interfere with the normal opening and closing of the door, i.e., the strap thickness is configured to fit between the door 12 and the door jamb (not shown). The strap 30 is, preferably, made from steel or aluminum material which will provide sufficient strength for supporting the mounting frame 14 and ironing board 12, while maintaining a minimal strap thickness.

The hook portion 30 of the bracket 28 is designed to engage snugly with the top of the door 16 so as to position the mounting frame 14 relatively flush against the face of the door. The snug engagement of the hook portion 30 to the door 16 also minimizes motion between the mounting frame 14 and the door 16 during opening and closing of the door, as well as during the ironing operation. Alternately, the hook portion 30 of the bracket 28 may be designed to attach to the top of the door 16 with a relatively loose fit so as to accommodate variations in door thickness. In such an embodiment, a clamping mechanism may be incorporated which would maintain the mounting frame 14 flush against the door 16.

In the preferred embodiment, the bracket 28 comprises two bracket straps which are spaced laterally apart and which attach to and extend vertically upward from the legs 24 of the mounting frame 14. The bracket strap and hook portion are continuous in the embodiment illustrated in the figures. Referring now to FIG. 4, at least one and preferably three protruding members 32 are formed on each bracket strap 28 and are designed to engage with slotted keyways 34 formed on the vertical legs 24 of the mounting frame. More specifically, a plurality of vertically spaced, slotted keyways 34 are formed on the legs 24 of the mounting frame and are designed to engage with the protruding members 32 on the bracket straps for permitting the vertical adjustment of the mounting frame 14 with respect to the bracket straps 28. That is, the protruding members 32 on each bracket strap 28 can be engaged with selected keyways 34 in the mounting frame to vertically position the mounting frame 14 at an operative height for the intended user. Accordingly, when a user desires or requires a lower horizontal position of the ironing board 12, the uppermost slotted keyways 34 would be engaged with the lowermost protruding members 32, and vice-versa.

Figure 5:
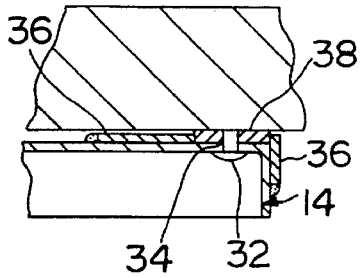
FIG. 5 a partial side view taken along lines 5—5 of FIG. 3 and illustrates the guide means of the present invention.

FIG. 5, which is a partial side view taken along lines 5—5 of FIG. 3, illustrates guides 36 positioned on the back of the mounting frame 14, on either side of each bracket strap 28. The guides 36 function to vertically orient the bracket straps 28 and to prevent lateral motion of the mounting frame 14 with respect to the bracket straps 28. For example, during normal opening and closing of the door 16 or during ironing of clothes, lateral loads may be exerted on the mounting frame 14, urging it to sway to the sides. In order to prevent the mounting frame 14 from shifting with respect to the bracket straps 28, guides 36 are formed on the mounting frame 14 adjacent to the sides of the bracket straps 28. The guides work, with the protruding members 32, to provide a relatively rigid mounting frame/bracket strap attachment to minimize any lateral motion therebetween. The guides 36 are made from a suitable material, such as steel, and may be formed either integral with the mounting frame 14 or separately attached thereto, such as by welding. In the embodiment shown in FIG. 5, the guides 36 are flat metal straps which are welded to the vertical legs 24 and the crossbar 26. Those skilled in the art could readily appreciate the diverse guide mechanisms that may be substituted for the metals straps without departing from the invention.

Referring back to FIG. 3, the mounting frame 14 has at least one basket 20 removably attached thereto which is, preferably, located below the ironing board 12 so as to provide easy access to items contained therein. The basket 20 may also be mounted above the ironing board, if so desired. The basket 20 has at least one and, more preferably, two basket mounts 38 positioned on opposite sides of the basket 20 for attaching the basket to mounting members 40 on the mounting frame 14. The basket mounts 38 may be separately attached to the basket or, more preferably, comprise metal rungs which are part of or extend upward from the metal wire basket 20. In an alternate embodiment (not shown), there are two baskets separately attached to the mounting frame 14.

The mounting members 40 include at least one tab formed on each leg 24 of the mounting frame 14. The tabs 40 may be formed from the mounting frame itself by cutting and bending a portion of the leg 24 outward from the mounting frame 14, or the tabs may be separately attached to the mounting frame 14 such as by welding, bonding or fastening. In the embodiment illustrated in the figures, there are two tabs which are bent outward from each leg, and which are spaced vertically apart permitting the basket 20 to be mounted at various vertical positions with respect to the mounting frame 14.

Figure 6A:
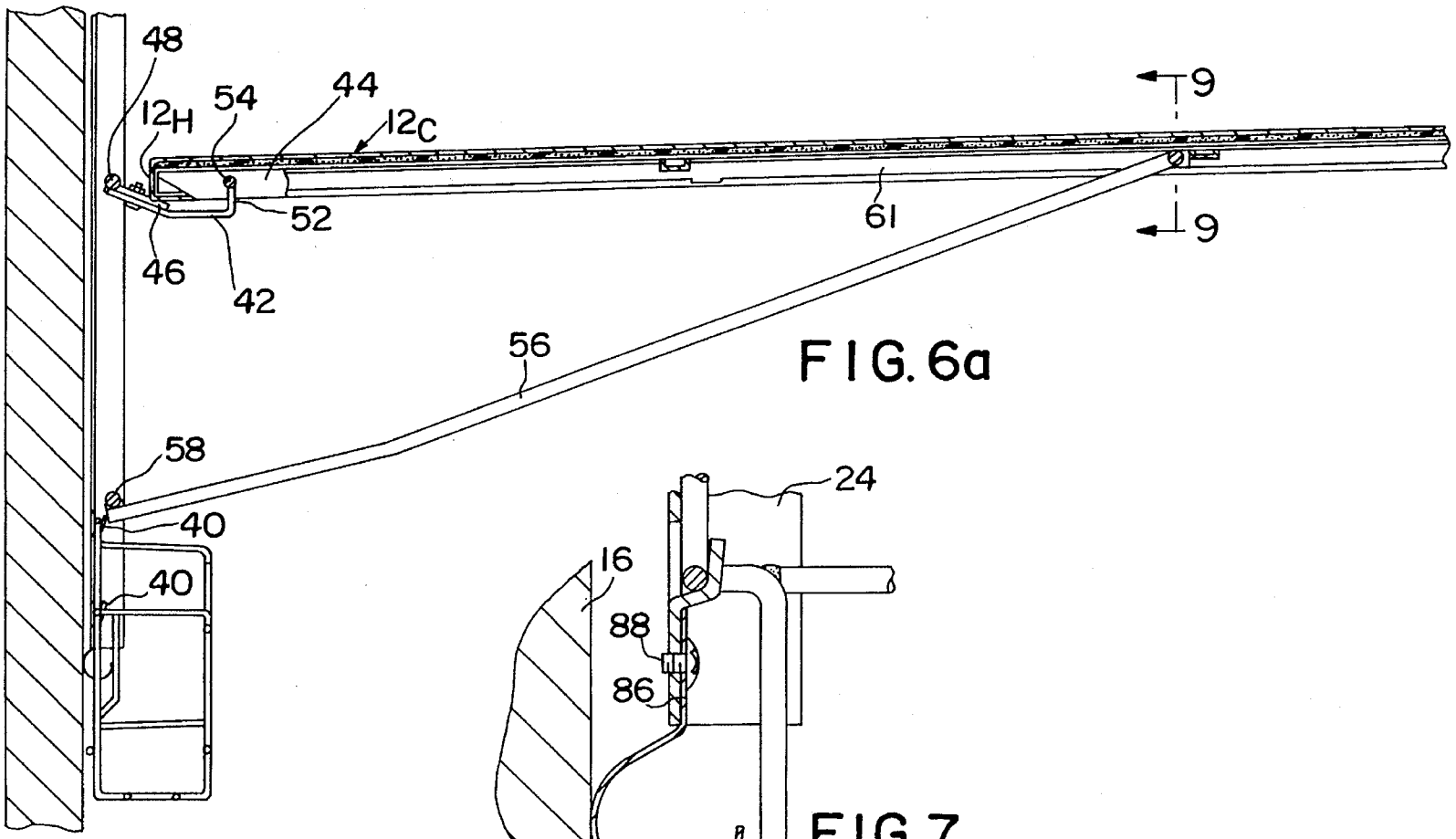
FIG. 6*a* a partial side view taken along lines 6—6 of FIG. 3 and illustrates the ironing board of the present invention in a lowered and operative position.
Figure 7:
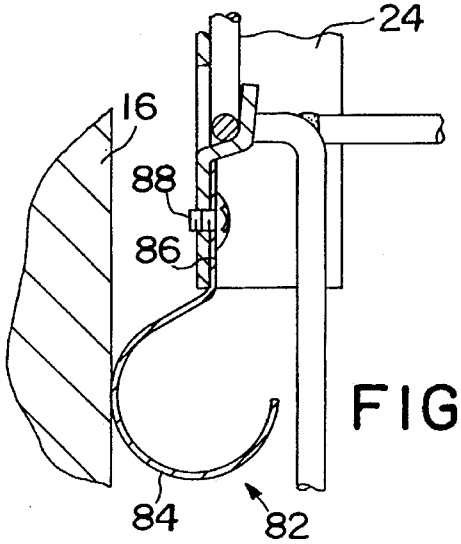
FIG. 7 is a detail view of one embodiment of the spring means according to the present invention.

Referring now to FIGS. 2 and 6*a*, the ironing board 12 is shown its lowered, substantially horizontal position. As discussed hereinabove, the ironing board 12 is pivotable with respect to the mounting frame 14. The pivot attachment will be discussed in more detail below. Longitudinal framing supports 44, mounted to the bottom of the ironing board 12, have two support arms 42 attached thereto at a location proximal to the heel $12_H$ of the ironing board. The opposite end of each support arm 42 has a clamp 46 fastened to it which is welded to an upper pivot bar 48. The upper pivot bar 48 extends between the vertical legs 24 of the mounting frame 14 with the ends of the bar passing through holes 50 formed in the legs 24. Fasteners (not shown), such as cotter pins, are utilized to retain the ends of the upper pivot bar 48 in the holes 50, while permitting the upper pivot bar 48 to rotate therein. Pivoting of the ironing board 12, and the attached support arms 42, causes corresponding rotation of the upper pivot bar 48 within the holes 50 of the mounting frame legs 24. While each clamp 46 is shown separately attached to a support arm 42 by a fastener, the clamp 46 may instead be formed integral with or welded to the support arm 42.

In an alternate embodiment (not shown), the upper pivot bar 48 may be fixed to the mounting frame 14 and, therefore, not rotatable. Instead, each clamp has a hollow cylinder formed at its distal end which is parallel to the heel $12_H$ of the ironing board and which is disposed about the upper pivot bar 48 so as to permit rotation therebetween. Lowering of the ironing board 12 from the raised position will, accordingly, result in rotation of the hollow cylinder about the upper pivot bar 48.

Figure 6B:
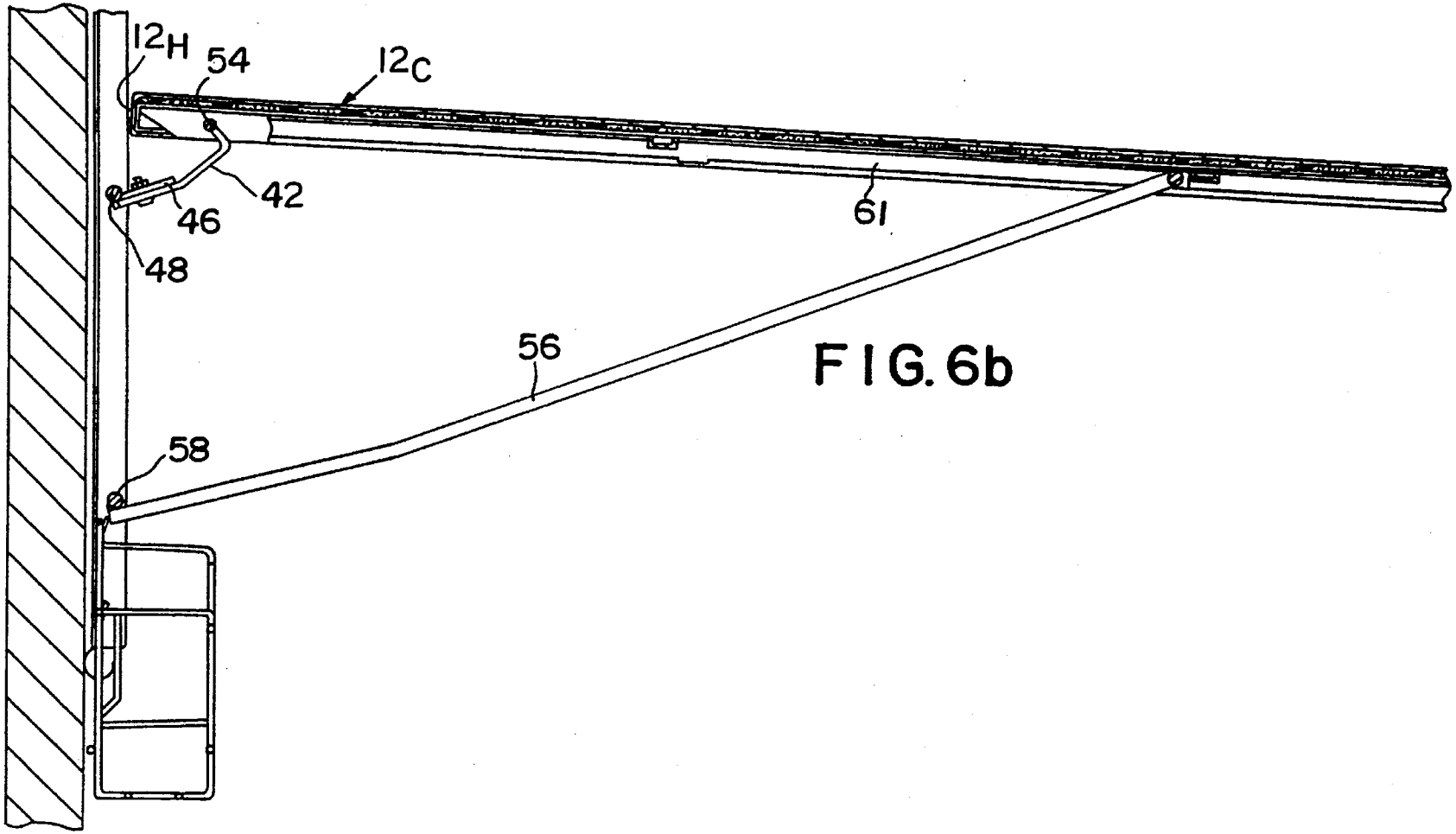
FIG. 6*b* a partial side view which illustrates the ironing board of the present invention in a lowered position with the ironing board surface vertically displaced for permitting a cover to be placed thereon.

When the ironing board 12 is in the horizontal position shown in FIG. 6*a*, the heel $12_H$ of the ironing board rests on and is supported by the support arms 42. As is evident from the figure, the placement or removal of an ironing board cover $12_C$ around the periphery of the ironing board 12 is inhibited by contact between the support arms 42 and the heel $12_H$. In order to permit the ironing board cover $12_C$ to be easily placed on and removed from the ironing board 12, vertical displacement of the ironing board heel $12_H$ with respect to the support arms 42 is provided in the preferred embodiment. Vertical displacement is achieved by the pivotal attachment of the support arms 42 to the longitudinal framing supports 44 of the ironing board. As shown more clearly in FIGS. 2, 6*a* and 6*b*, a lateral projection 52 of each support arm 42 is welded to a cross member 54 which extends between and is rotatable with respect to the longitudinal framing members 44, thus providing a pivotable attachment. The pivoting of the ironing board with respect to the support arms permits the user to lift the ironing board heel $12_H$ vertically, while it is in the horizontal position, causing the support arms 42 to pivot and separate from the heel $12_H$ of the ironing board as shown in FIG. 6*b*. Placement or removal of the ironing board cover $12_C$ is, therefore, relatively simple and does not require cutting or altering the cover.

Figure 9:
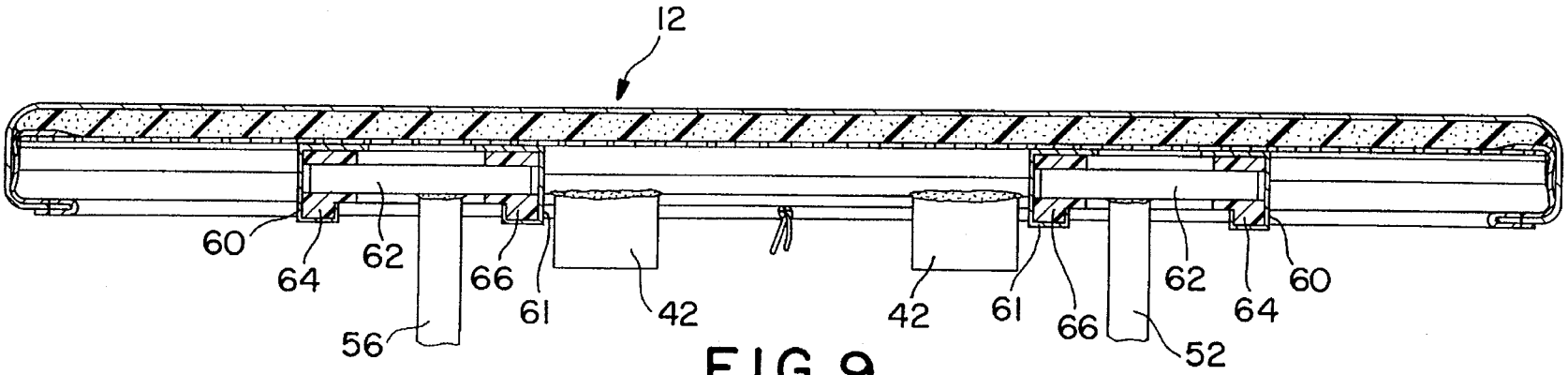
FIG. 9 is a cross-sectional view of the ironing board of the present invention taken along line 9—9 of FIG. 6*a* and illustrating the slide rails.

FIG. 6*a* shows two support braces 56 attached between the mounting frame 14 and the ironing board 12 which are designed to support the ironing board 12 during the ironing process. Each support brace is pivotally connected to the mounting frame 14 by means of a lower pivot bar 58. The lower pivot bar extends between and attaches to the legs 24 of the mounting frame 14 in similar fashion to the upper pivot bar 48 discussed above. The support brace 56 is attached to the lower pivot bar 58, preferably through a welded or bonded joint, although other means for attaching the two elements, including making the two elements as a single piece, are well within the scope of this invention. Referring to FIG. 9, one end of each support brace 56 is slidably engaged with inner and outer slide rails 60, 61 which are mounted to the lower surface of the ironing board 12. An axle 62 is attached to each support brace 56 and extends between and is pivotable within slide blocks 64, 66 that glide within and are retained by the slide rail 60, 61. The axle 62 and support brace 56 are, preferably, made from steel or aluminum material so as to provide sufficient strength to react the loads imposed during ironing, as will be discussed in more detail hereinafter. The slide blocks 64, 66 are, preferably, made from a low friction material, e.g., nylon, or coated with a low friction film, e.g., polytetrafluoroethylene, so that they glide smoothly within the slide rails 60, 61. The inner and outer slide rails 60, 61 may be formed as a single unit if desired. However, in the preferred embodiment, the inner rail 61 and the longitudinal framing support 44 form a continuous structural support for the ironing board.

During ironing, a significant amount of load is applied in a downward direction on the outer portion of the ironing board 12 which must be reacted by the mounting frame 14 and, eventually, by the door 16. In order to provide sufficient support for this load, and to maximize the stability of the ironing board 12, the support braces 56 are configured such that when the ironing board 12 is in the lowered, operative position, the support braces 56 are located outboard of the midway point on the ironing board 12. That is, the support braces 56 are positioned relatively close to where a significant amount of the ironing loads are applied. As a result, the ironing board has a relatively stable surface on which to iron.

As discussed earlier, the ironing board 12 is retained in its vertical, raised position by a latch 18. The latch 18 has a first position wherein the latch 18 is engaged with the ironing board 12 and has a second position wherein the latch 18 is deflected out of engagement with the ironing board 12. Accordingly, when the latch 18 is in the first position, the ironing board 12 is retained in its raised position and cannot readily pivot downward, even during opening and closing of the door. When the latch 18 is its second position, i.e., deflected out of engagement with the ironing board 12, the ironing board 12 is free to pivot between the raised and the lowered position. Movement of the ironing board 12 between the raised and lowered positions, causes the ironing board 12 to force the latch 18 to move between its first and second positions. For example, when it is desired to lower the ironing board 12, the user pulls the ironing board 12 away from the mounting frame, causing a wheel 68 to rotate around the ironing board 12 and a yoke 70 to deflect into the latch's second position. Raising the ironing board 12 into the stored position produces an opposite result.

Figure 11:
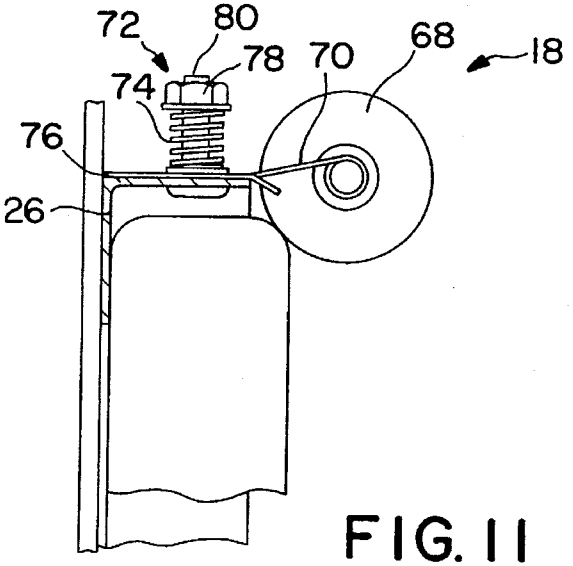
FIG. 11 is a detailed side view of the latch according to the present invention.
Figure 10:
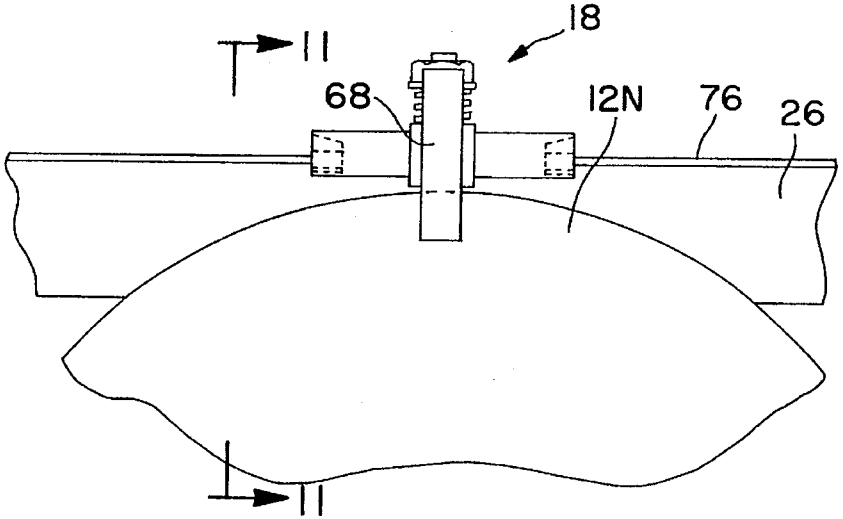
FIG. 10 is a detailed front view of the latch according to the present invention.

In the preferred embodiment, which is illustrated in FIGS. 10 and 11, the latch 18 comprises a wheel 68 rotatably mounted to a yoke 70 which is attached to the mounting frame 14 at a location proximal to the ironing board 12 while in its raised position such that the wheel 68 engages with a portion of the ironing board 12. In the preferred embodiment, the yoke 70 is attached to the crossbar 26 adjacent to the ironing board nose. The wheel 68 may be made from any suitable material, although plastic material is preferred for its durability and lightweight characteristics.

In order to prevent the normal opening and closing of the door 16 from deflecting the latch 18 into its second position and, thereby, permitting the ironing board 12 to rotate, a biasing means 72 is provided which urges the latch 18 into its first position. The biasing means 72 is, preferably, a spring 74 attached to the mounting frame 14 which biases the yoke 70 against the mounting frame. FIG. 11 illustrates the spring 74 mounted to the upper leg 76 of the crossbar 26 through a nut and bolt arrangement 78, 80. The yoke 70 is positioned between the spring 74 and the mounting frame 14 and has a hole formed therethrough for permitting the bolt 80 to pass. The spring 74 urges the yoke 70 to bear against the frame 76, which corresponds to the latch's first position. In order to deflect the latch 18 into the second position, a sufficient force must be applied to the latch 18 to cause the yoke 70 to compress the spring 74 against the nut 78. The amount of force required will vary depending on the type of spring 74 chosen and its associated spring force.

In an alternate embodiment of the invention (not shown), the wheel 68 of the latch 18 is mounted to a strap which is, in turn, attached to the mounting frame 14. The strap, which has a prescribed spring rate, acts in a similar fashion to the spring 74, when it is deflected. That is, the deflection of the strap produces a biasing effect on the wheel 68, urging it back towards the latch's first position. Other variations in means for biasing the latch 18 may be readily substituted for the embodiments disclosed above without departing from the scope of the invention.

As discussed earlier, the frame is held snug against the face of the door such that normal opening and closing of the door does not produce lateral shifting of the ironing board. That is, the normal force of gravity, in combination with the configuration of the bracket means 28, causes the mounting frame 14 to lie flush against the face of the door. However, opening and closing of the door, as well as normal ironing, could potentially cause the mounting frame 14 to impact the face of the door resulting in damage. In order to prevent direct impact of the door by the mounting frame, a spring means 82 is attached to the mounting frame 14 to biases the same away from the face of the door. The spring means 82 is generally depicted in FIG. 1 as being mounted at the lower end of the vertical legs 24 of the mounting frame. Specific embodiments of the spring means 82 will now be discussed with reference to FIGS. 7 and 8*a*–8*c*.

In one embodiment of the invention, there is one spring 82 positioned on the lower end of each vertical leg which comprises a strap having an arcuate surface 84 and a mounting flange 86. The mounting flange 86 attaches the spring 82 to the vertical leg 24 and positions the arcuate surface 84 towards the face of the door when the mounting frame 14 is hung on a door. The spring mounting flange 86 may be attached to the frame by a fastener 88 or, alternately, may be formed integral with the mounting frame 14. The spring may be made from any of a variety of materials which provide a degree of resiliency, however, spring steel is preferred.

Figure 8A:
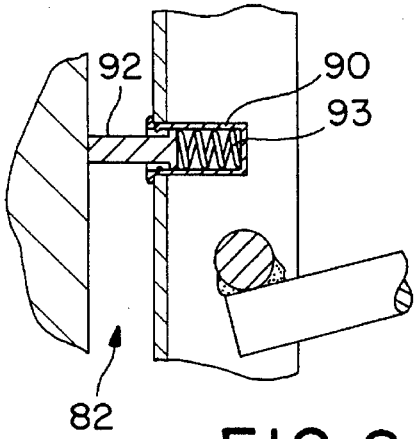
FIG. 8*a* is a detail view of a second embodiment of the spring means according to the present invention.
Figure 8B:
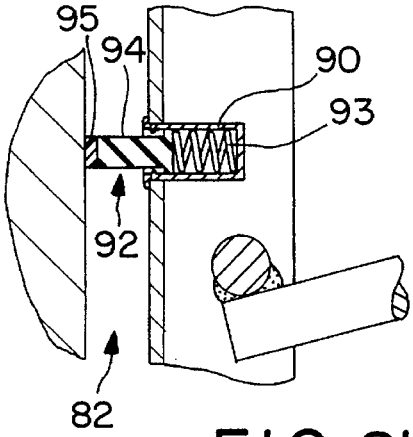
FIG. 8*b* is a detail view of a third embodiment of the spring means according to the present invention.
Figure 8C:
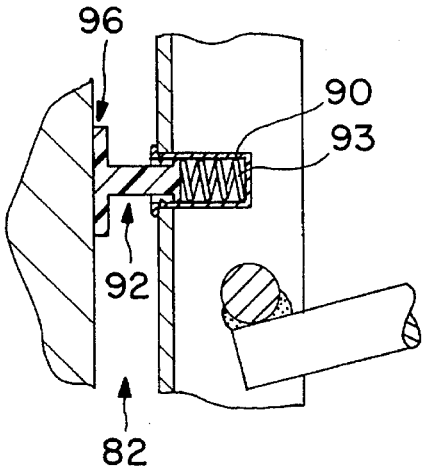
FIG. 8*c* is a detail view of a fourth embodiment of the spring means according to the present invention.

In an alternate embodiment, illustrated in FIGS. 8*a*–8*c* the spring means 82 has a piston-type configuration with hollow base cylinder 90 into which a second cylinder 92, having a diameter slightly smaller than the base cylinder 90, is slidably disposed. An internal spring 93 is positioned between the base cylinder 90 and the second cylinder 92 so as to permit reciprocating motion therebetween. The base cylinder 90 is, preferably, press-fit into an aperture formed in leg 24 of the mounting frame 14 with the second cylinder 92 directed toward the face of the door when the mounting frame is hung on the door. Accordingly, in this embodiment of the spring means 82, deflection of the mounting frame 14 towards the door will be absorbed, to some extent, by compression of the internal spring 93.

The base cylinder 90 may be made from a metallic material, such as steel, or alternately from a plastic material, preferably polyvinyl chloride (PVC). The second cylinder 92 may also be made from a metallic material, such as steel, or instead from a plastic material, preferably polyvinyl chloride (PVC).

In an alternate construction of the spring means 82, shown in FIG. 8*b*, the second cylinder 92 may be made from a composite of rubber and plastic materials. In such an embodiment, the main portion 94 of the second cylinder 92 may be manufactured from rubber having a suitable durometer for assisting the internal spring 93 in absorbing the deflections of the mounting frame 14 against the door. A tip 95 is attached to the main portion 94, such as by bonding, and is, preferably, made from a hard plastic material with a low friction coefficient, such as polyvinyl chloride.

FIG. 8*c* illustrates yet another embodiment of the spring means 82 wherein the second cylinder 92 has a circular contact pad 96 attached thereto which contacts the face of the door. The circular contact pad is preferably larger in diameter than the second cylinder 92 and may be formed as an integral extension of the second cylinder 92. The circular contact pad 96 is, preferably, made from a hard plastic material, such as polyvinyl chloride. If the chosen construction of the mounting frame 14 is such that lateral shifting of the ironing board 10 results during ironing, the circular pad may be made from a frictional material or have a frictional material placed thereon for providing frictional contact with the face of the door and, thereby, inhibit the swaying of the frame. It should be evident from the above discussion that the base cylinder 90 and second cylinder 92 of the spring means may be formed from the same or different types of material.

Figure 12:
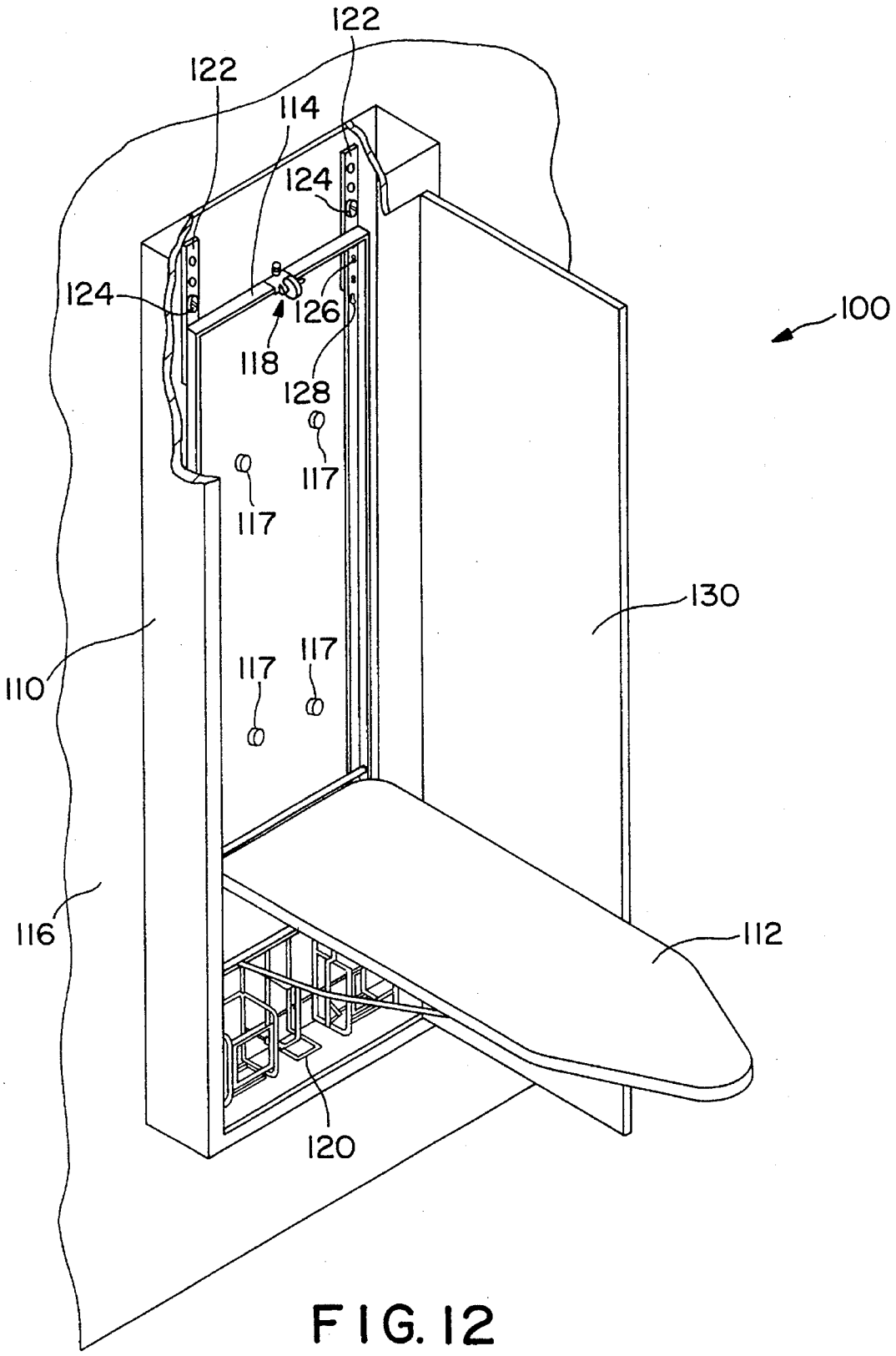
FIG. 12 is an isometric view of an alternate embodiment of the present invention wherein the mourning frame is attached to the inside of a cabinet with a cover.

The invention has been illustrated and discussed as being generally mountable to a door with an ironing board that is pivotable between a raised, stored position and a lowered operative position. In an alternate configuration of the invention illustrated in FIG. 12, and generally designated by the numeral 100, a pivotable ironing board 112 and mounting frame 114 are attached to the inside of a cabinet 110. The cabinet is shown mounted to a structure 116, such as wall or door, by means of bolts 117.

As with the previous embodiment, the mounting frame 114 has a latch 118 attached to the mounting frame 114 for retaining the ironing board 112 in the raised, stored position. The mounting frame also has a basket 120 which is removably attached to the frame in a similar fashion as the previous embodiment.

A bracket means 122 is attached, by means of fasteners 124, such as bolts, to the back, inside surface of the cabinet 110. In the preferred configuration of this embodiment, the bracket means comprises two vertically oriented straps. The straps have protruding members 126 formed thereon and extending therefrom which are designed to engage with slotted keyways 128 formed in the mounting frame. As with the previous embodiment of the invention discussed above, the protruding members 126 and slotted keyways 128 permit the ironing board to be vertically adjusted within the cabinet 110.

A cover or door 130 is mounted to the cabinet 110 by means of hinges (not shown), permitting the ironing board to be hidden from view when in its raised position and not in use.

Many of the details of the door hanging ironing board 10 are applicable to the cabinet mounted ironing board 110 are do not need to be repeated. Those skilled in the art could readily apply and modify the teachings each embodiment without departing from the intent and scope of the invention. For example, if adjustability of the ironing board is not critical, the mounting frame may be attached directly to the wall. Additionally, the cover may be attached directly to the mounting frame without the need for a cabinet.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

What is claimed:

1. An ironing board assembly for mounting to a door comprising:

a bracket for engaging with the top of the door having an inverted, generally J-shaped hook portion;

a mounting frame attached to said bracket and having two vertically oriented legs;

an ironing board pivotally attached to the legs of said mounting frame and pivotable between a substantially horizontal position when said board is in use and a substantially vertical position when said board is not in use;

a latch attached to said mounting frame for retaining said ironing board in said vertical position, said latch having a first position wherein said latch is engaged with said ironing board when in said vertical position, and a second position wherein said latch is deflected so as not to be engaged with said ironing board, said latch being movable between its first and second positions, said ironing board being free to pivot when said latch is in said second position; and means formed on the frame for biasing said latch into said first position.

2. An ironing board assembly according to claim 1 wherein said latch includes a wheel rotatably mounted to a yoke, said wheel being configured to engage with a portion of said ironing board, and wherein said yoke attaches to said mounting frame at a location proximal to said ironing board when said ironing board is in the raised position.

3. An ironing board assembly according to claim 2 wherein said biasing means is a spring attached to said yoke for biasing said yoke and said wheel into the first position.

4. An ironing board assembly according to claim 2 wherein said latch is positioned near the nose of said ironing board, and wherein said wheel engages with the nose of said ironing board.

5. An ironing board assembly according to claim 1 wherein said biasing means includes a strap attached to said mounting frame and wherein said latch includes a wheel attached to said strap and configured to engage with a portion of said ironing board, said strap biasing said wheel into engagement with an edge of the ironing board.

6. An ironing board assembly according to claim 1 further including a basket removably attached to said mounting frame and having at least one basket mount, said basket mount being configured to engage with corresponding mounting members on said mounting frame.

7. An ironing board according to claim 1 wherein the legs of said mounting frame are vertically oriented metal angles positioned on either side of said ironing board, said mounting frame further including a horizontal crossbar extending between and attaching to the uppermost ends of said vertical legs, and wherein said bracket attaches to and extends vertically upward from the legs of said mounting frame, said mounting frame having guides formed thereon for vertically orienting said bracket, the guides permitting vertical motion of the mounting frame with respect to the bracket while preventing lateral motion of said mounting frame with respect to said bracket.

8. An ironing board assembly according to claim 7 wherein said bracket comprises two inverted generally J-shaped straps; each strap having at least one outwardly protruding member formed thereon which is designed to mate with one of a plurality of slotted keyways formed in said mounting frame, said keyways permitting vertical adjustment of the frame with respect to said bracket.

9. An ironing board assembly according to claim 1 further comprising a support brace having a first end pivotally mounted to said mounting frame and a second end slidably engaged with said ironing board, the slidable engagement designed so as to position the second end of said support brace at a point more than halfway outboard on said ironing board in its horizontal position for maximizing support thereof.

10. An ironing board assembly for mounting to a door comprising:

a bracket for engaging with the top of the door having an inverted, generally J-shaped hook portion;

a mounting frame attached to said bracket and having two vertically oriented legs;

an ironing board pivotally attached to the legs of said mounting frame and pivotable between a substantially horizontal position when said board is in use and a substantially vertical position when said board is not in use;

a latch attached to said mounting frame for retaining said ironing board in said vertical position, said latch having a first position wherein said latch is engaged with said ironing board when in said vertical position, and a second position wherein said latch is deflected so as not to be engaged with said ironing board, said ironing board being free to pivot when said latch is in said second position;

means for biasing said latch into said first position; and a basket removably attached to said mounting frame and having at least one basket mount, said basket mount being configured to engage with corresponding mounting members on said mounting frame, wherein said at least one basket mount comprises two rungs positioned on opposite sides of said basket, and wherein said corresponding mounting members comprise at least one tab extending from each leg of said mounting frame and are shaped to receive and support said rungs.

11. An ironing board assembly according to claim 10 wherein there are two sets of said tabs mounted on each leg and spaced vertically apart so as to permit height adjustment of said basket with respect to said frame.

12. An ironing board assembly for mounting to a door comprising:

a bracket for engaging with the top of the door having an inverted, generally J-shaped hook portion;

a mounting frame attached to said bracket and having two vertically oriented legs:

an ironing board pivotally attached to the legs of said mounting frame and pivotable between a substantially horizontal position when said board is in use and a substantially vertical position when said board is not in use;

a latch attached to said mounting frame for retaining said ironing board in said vertical position, said latch having a first position wherein said latch is engaged with said ironing board when in said vertical position, and a second position wherein said latch is deflected so as not to be engaged with said ironing board, said ironing board being free to pivot when said latch is in said second position;

means for biasing said latch into said first position; and spring means mounted to said mounting frame and adapted to face the door for biasing said mounting frame away from the door.

13. An ironing board assembly according to claim 12 wherein said spring means comprises a strap adapted to be disposed between said mounting frame and the door, said strap having an arcuate surface attached to said mounting frame and adapted to face to door.

14. An ironing board assembly according to claim 12 wherein said spring means comprises a piston arrangement having first and second concentric cylinders with a spring interposed therebetween, said first cylinder being affixed to said mounting frame and said second cylinder adapted to contact the door.

15. An ironing board assembly according to claim 14 wherein at least a portion of said second cylinder is made from plastic material.

16. An ironing board assembly for mounting to a door comprising:

a bracket for engaging with the top of the door having an inverted, generally J-shaped hook portion;

a mounting frame attached to said bracket and having two vertically oriented legs;

an ironing board pivotally attached to the legs of said mounting frame and pivotable between a substantially horizontal position when said board is in use and a substantially vertical position when said board is not in use; and a guide on said :mounting frame for vertically orienting said bracket, the guide permitting vertical motion of the mounting frame with respect to the bracket while preventing lateral motion of said mounting frame with respect to said bracket.

17. An ironing board according to claim 16 wherein said guide extends from said mounting frame and is positioned adjacent to and on either side of said bracket for vertically orienting said bracket with respect to said mounting frame.

18. An ironing board assembly for mounting to a door comprising:

a bracket for engaging with the top of the door having an inverted, generally J-shaped hook portion;

a mounting frame attached to said bracket and having two vertically oriented legs;

an ironing board pivotally attached to the legs of said mounting frame and pivotable between a substantially horizontal position when said board is in use and a substantially vertical position when said board is not in use; and a guide on said mounting frame for vertically orienting said bracket and for preventing lateral motion of said mounting frame with respect to said bracket, wherein said guide extends from said mounting frame and is positioned adjacent to and on either side of said bracket for vertically orienting said bracket with respect to said mounting frame, and wherein said guide comprises strap members attached to said mounting frame on either side of said bracket.

19. An ironing board assembly for mounting to a door comprising:

a bracket for engaging with the top of the door having an inverted, generally J-shaped hook portion;

a mounting frame attached to said bracket and having two vertically oriented legs;

an ironing board pivotally attached to the legs of said mounting frame and pivotable between a substantially horizontal position when said board is in use and a substantially vertical position when said board is not in use;

guides means attached to said mounting frame for vertically orienting said bracket, the guides permitting vertical motion of the mounting frame with respect to the bracket while preventing lateral motion of said mounting frame with respect to said bracket;

a latch attached to said mounting frame for retaining said ironing board in said vertical position, said latch having a first position wherein said latch is engaged with said ironing board when in said vertical position, and a second position wherein said latch is deflected so as not to be engaged with said ironing board, said latch being movable between its first and second positions, said ironing board being free to pivot when said latch is in said second position;

means formed on the frame for biasing said latch into said first position; and a basket removably attached to said mounting frame and having at least one basket mount, said basket mount being configured to engage with corresponding mounting members on said mounting frame.

20. An ironing board assembly comprising:

a mounting frame;

a bracket connected to said mounting frame for attaching said mounting frame to a structure;

an ironing board having a nose and heel; and means for pivoting said ironing board with respect to said mounting frame, said pivot means having a first pivotal attachment fixedly formed on said mounting frame and proximate to the heel, said first pivotal attachment for pivoting said ironing board between a substantially horizontal position when said ironing board is in use and a substantially vertical position when said ironing board is not in use, and a second pivotal attachment located on said ironing board for permitting vertical displacement of the heel of said ironing board when in the horizontal position, and means for interconnecting said first and second pivotal attachments, said heel of said ironing board being supported on said means for interconnecting when in the horizontal position, whereby when said ironing board is vertically displaced, said means for interconnecting is separated from said heel of said ironing board allowing the placement or removal of an ironing board cover.

21. The ironing board assembly according to claim 20 wherein said bracket has at least one member protruding therefrom, and wherein said mounting frame has slotted keyways formed thereon for engaging with and being removably supported by said at least one protruding member on said bracket.

22. The ironing board assembly according to claim 21 further including a cabinet mountable to a structure and having a cover hingedly attached thereto, said bracket being affixed to an inside surface of said cabinet such that the at least one protruding member extends away from said inside surface and positions said mounting frame within said cabinet when attached to said bracket.

23. An ironing board assembly for mounting to a door comprising:

a bracket having at least one member protruding therefrom;

a mounting frame having slotted keyways formed thereon for engaging with and being supported by the at least one protruding member on said bracket, said mounting frame having two vertically oriented legs;

an ironing board pivotally attached to the legs of said mounting frame and pivotable between a substantially horizontal position when said board is in use and a substantially vertical position when said board is not in use;

guides means attached to said mounting frame for vertically orienting said bracket and for preventing lateral motion of said mounting frame with respect to said bracket;

a latch attached to said mounting frame for retaining said ironing board in said vertical position, said latch having a first position wherein said latch is engaged with said ironing board when in said vertical position, and a second position wherein said latch is deflected so as not to be engaged with said ironing board, said ironing board being free to pivot when said latch is in said second position;

means for biasing said latch into said first position; and a cabinet mountable to a structure and having a cover hingedly attached thereto, said bracket being affixed to an inside surface of said cabinet such that the at least one protruding member extends away from said inside surface and positions said mounting frame within said cabinet when attached to said bracket.

24. An ironing board assembly for mounting to a door comprising:

a bracket for engaging with the top of the door having an inverted, generally J-shaped hook portion;

a mounting frame attached to said bracket and having two vertically oriented legs;

an ironing board pivotally attached to the legs of said mounting frame and pivotable between a substantially horizontal position when the board is in use and a substantially vertical position when the board is not in use;

a latch attached to said mounting frame for retaining the ironing board in its vertical position; and a basket mounted below the ironing board, the basket being movable between first and second positions, the basket being adapted to support articles in at least one of the positions, the ironing board being pivotable with respect to the basket.

25. An ironing board assembly according to claim 24 wherein the basket is formed from wire rungs.

26. An ironing board assembly according to claim 24 wherein the first and second positions of the basket are vertically spaced from one another.

27. An ironing board assembly according to claim 26 wherein the basket is attached to the ironing board assembly in both positions.

28. An ironing board assembly according to claim 24 wherein the basket is located adjacent to the mounting frame when the ironing board is pivoted into its vertical position.

29. An ironing board assembly for mounting to a door comprising:

a bracket for engaging with the top of the door having an inverted, generally J-shaped hook portion;

a mounting frame attached to said bracket and having two vertically oriented legs;

an ironing board pivotally attached to the legs of said mounting frame and pivotable between a substantially horizontal position when the board is in use and a substantially vertical position when the board is not in use;

a latch attached to said mounting frame for retaining the ironing board in its vertical position; and a basket mounted below the ironing board, the basket being movable with respect to the mounting frame, the basket being formed from wire rungs, the ironing board being pivotable with respect to the basket, the basket being located adjacent to the mounting frame when the ironing board is pivoted into its vertical position.

* * * * *